US009926790B2

(12) United States Patent
Landwehr et al.

(10) Patent No.: US 9,926,790 B2
(45) Date of Patent: Mar. 27, 2018

(54) COMPOSITE TURBINE COMPONENTS ADAPTED FOR USE WITH STRIP SEALS

(71) Applicant: Rolls-Royce Corporation, Indianapolis, IN (US)

(72) Inventors: Sean E. Landwehr, Avon, IN (US); Joseph P. Lamusga, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 303 days.

(21) Appl. No.: 14/797,874

(22) Filed: Jul. 13, 2015

(65) Prior Publication Data

US 2016/0017721 A1 Jan. 21, 2016

Related U.S. Application Data

(60) Provisional application No. 62/026,814, filed on Jul. 21, 2014.

(51) Int. Cl.
*F01D 5/22* (2006.01)
*F01D 11/00* (2006.01)

(52) U.S. Cl.
CPC ..... *F01D 5/225* (2013.01); *F01D 11/005* (2013.01); *F05D 2220/32* (2013.01); *F05D 2230/237* (2013.01); *F05D 2230/60* (2013.01); *F05D 2240/11* (2013.01); *F05D 2240/55* (2013.01); *F05D 2300/20* (2013.01); *F05D 2300/6033* (2013.01)

(58) Field of Classification Search
CPC ..... F01D 5/225; F01D 11/005; F01D 11/08; F05D 2230/237; F05D 2240/11; F05D 2240/55; F05D 2300/6033
See application file for complete search history.

(56) References Cited

U.S. PATENT DOCUMENTS

| | | | | |
|---|---|---|---|---|
| 6,312,218 | B1 * | 11/2001 | Beeck | F01D 11/005 415/173.7 |
| 6,441,341 | B1 | 8/2002 | Steibel et al. | |
| 6,670,026 | B2 | 12/2003 | Steibel et al. | |
| 6,935,836 | B2 | 8/2005 | Ress, Jr. et al. | |
| 7,329,087 | B2 | 2/2008 | Cairo et al. | |
| 7,771,159 | B2 | 8/2010 | Johnson et al. | |
| 7,870,738 | B2 | 1/2011 | Zborovsky et al. | |
| 8,132,442 | B2 | 3/2012 | Merrill et al. | |
| 8,246,299 | B2 * | 8/2012 | Razzell | F01D 11/005 415/116 |
| 8,322,977 | B2 * | 12/2012 | Beeck | F01D 11/005 415/139 |
| 8,496,431 | B2 * | 7/2013 | Habarou | F01D 9/04 415/170.1 |
| 2012/0171027 | A1 * | 7/2012 | Albers | F01D 11/005 415/208.1 |

* cited by examiner

*Primary Examiner* — Kenneth Bomberg
*Assistant Examiner* — Hoon Choi
(74) *Attorney, Agent, or Firm* — Barnes & Thornburg LLP

(57) ABSTRACT

A turbine shroud for a turbine of a gas turbine engine is disclosed. The turbine shroud is configured to direct products of a combustion reaction in a combustor of the gas turbine engine toward a plurality of rotatable turbine blades of the turbine to cause the plurality of turbine blades to rotate.

20 Claims, 5 Drawing Sheets

COMPOSITE TURBINE COMPONENTS ADAPTED FOR USE WITH STRIP SEALS

CROSS REFERENCE TO RELATED APPLICATIONS

This application claims priority to and the benefit of U.S. Provisional Patent Application No. 62/026,814, filed 21 Jul. 2014, the disclosure of which is now expressly incorporated herein by reference.

TECHNICAL FIELD

The present invention generally relates to gas turbine engines, and more particularly, to turbine shrouds used in gas turbine engines.

BACKGROUND

Gas turbine engines typically include a compressor, a combustor, and a turbine. The compressor compresses air drawn into the engine and delivers high pressure air to the combustor. In the combustor, fuel is mixed with the high pressure air and the air/fuel mixture is ignited. Products of the combustion reaction in the combustor are directed into the turbine where work is extracted to drive various components of the gas turbine engine.

Turbines typically include alternating stages of static vane assemblies and rotatable wheel assemblies. The rotatable wheel assemblies include disks carrying blades that are coupled to the disks. When the rotatable wheel assemblies turn in response to receiving the combustion reaction products, tips of the blades move along ceramic blade tracks included in static turbine shrouds surrounding the rotating wheel assemblies; thereby, work is extracted in the form of mechanical energy.

To maximize the mechanical energy extracted by the turbine, seals are arranged at circumferential interfaces between adjacent segments of the blade track to block leakage of combustion products through the blade track. The seals are sometimes located by slots formed in the blade track segments. Exposure of ceramic blade track segments to the combustion reaction products can result in the degradation of the blade track over time. Coatings are sometimes used to protect ceramic gas turbine engine components. However, applying coatings to the ceramic blade track segments inside seal-locating slots can present design and manufacturing challenges.

SUMMARY

The present disclosure may comprise one or more of the following features and combinations thereof.

According to one aspect of the present disclosure, a turbine shroud for a gas turbine engine may include a plurality of ceramic matrix composite blade track segments, a plurality of strip seals, and a plurality of strip-seal support inserts. The plurality of ceramic matrix composite blade track segments may be arranged circumferentially adjacent to one another to form a ring. The plurality of strip seals may be located circumferentially between adjacent ceramic matrix composite blade track segments. The plurality of strip-seal support inserts may be coupled to the ceramic matrix composite segments and formed to include strip-seal slots that receive the plurality of strip seals to hold the strip seals in place relative to the plurality of ceramic matrix composite blade track segments.

In some embodiments, each of the plurality of ceramic matrix composite blade track segments may be formed to include an insert-receiving cavity that receives at least a portion of the strip-seal support insert. Each of the plurality of ceramic matrix composite blade track segments may be bonded to a strip-seal support insert received in the insert-receiving cavity by a braze layer located in the insert-receiving cavity. Each of the plurality of ceramic matrix composite blade track segments may be bonded to a strip-seal support insert received in the insert-receiving cavity by a bond layer located in the insert-receiving cavity.

In some embodiments, each of the strip-seal support inserts may be formed to include a body portion that defines the strip-seal slots, and an attachment portion that is received in an insert-receiving cavity formed in each one of the ceramic matrix composite blade track segments. The attachment portion may be shaped to engage the ceramic matrix composite blade track segment and block circumferential movement of a strip-seal support insert relative to the ceramic matrix composite blade track segment. The attachment portion of each strip-seal support insert may have a dove-tail shape, and the insert-receiving cavity of each ceramic matrix composite blade track segment may include an axially-extending dove-tail shaped channel that receives the attachment portion of each strip-seal support insert. The insert-receiving cavity of each ceramic matrix composite blade track segment may include an axially-extending channel that receives both the body portion and the attachment portion of each strip-seal support insert.

In some embodiments, the plurality of strip-seal support inserts may be constructed from material including a rare earth silicate. The plurality of strip-seal support inserts may be constructed from a material including at least one of an alkaline earth material, an alkaline aluminosilicate material, and mullite.

According to another aspect of the present disclosure, a turbine shroud segment for a gas turbine engine may include a ceramic matrix composite blade track segment, a first strip-seal support insert, and a second strip-seal support insert. The ceramic matrix composite blade track segment may include an arcuate runner that defines a radius around a central axis and an attachment feature adapted to couple the arcuate runner to a turbine case. The first strip-seal support insert may be coupled to a first end of the arcuate runner and formed to include a first strip-seal slot. The first strip-seal slot may be sized to receive a first strip seal and located adjacent to the first end of the arcuate runner. The second strip-seal support insert may be coupled to a second end of the arcuate runner opposite the first end and formed to include a second strip-seal slot. The second strip-seal slot may be sized to receive a second strip seal and located adjacent to the second end of the arcuate runner.

In some embodiments, the ceramic matrix composite blade track segment may be bonded to each of the first strip-seal support insert and the second strip-seal support insert. The first strip-seal support insert and the second strip-seal support insert may be constructed from material including a rare earth silicate. The first strip-seal support insert and the second strip-seal support insert may be constructed from a material including at least one of an alkaline earth material, an alkaline aluminosilicate material, and mullite.

In some embodiments, the ceramic matrix composite blade track segment may be formed to include a first insert-receiving cavity that receives at least a portion of the first strip-seal support insert, and a second insert-receiving cavity that receives at least a portion of the second strip-seal support insert. The first insert-receiving cavity may extend into the arcuate runner from the first end of the arcuate runner toward the second end of the arcuate runner, and the second insert-receiving cavity may extend into the arcuate runner from the second end of the arcuate runner toward the first end of the arcuate runner.

In some embodiments, the first strip-seal support insert and the second strip-seal support insert may each be formed to include a body portion that defines a strip-seal slot, and an attachment portion. The attachment portion may be received in the arcuate runner and shaped to engage the arcuate runner. The attachment portions of the first strip-seal support insert and the second strip-seal support insert may have a dove-tail shape. The first and second insert-receiving cavities of the ceramic matrix composite blade track segment may include an axially-extending channel that receives both the body portion and the attachment portion of the first and second strip-seal support inserts.

According to yet another aspect of the present disclosure, a method of assembling a turbine shroud for a gas turbine engine may include (i) forming a channel in one of a plurality of ceramic matrix composite blade track segments, (ii) positioning a strip-seal support insert in the channel, the strip-seal support insert having a slot formed therein, (iii) positioning a strip seal in the slot such that a portion of the strip seal extends to a point outside of the slot, and (iv) arranging the one ceramic matrix composite blade track segment relative to another ceramic matrix composite blade track segment of the plurality of ceramic matrix composite blade track segments such that the portion is received in a slot of a strip-seal support insert positioned in a channel of the another ceramic matrix composite blade track segment. In some embodiments, the method may include securing the strip-seal support insert in the channel using a braze layer.

DETAILED DESCRIPTION

Figure 1:
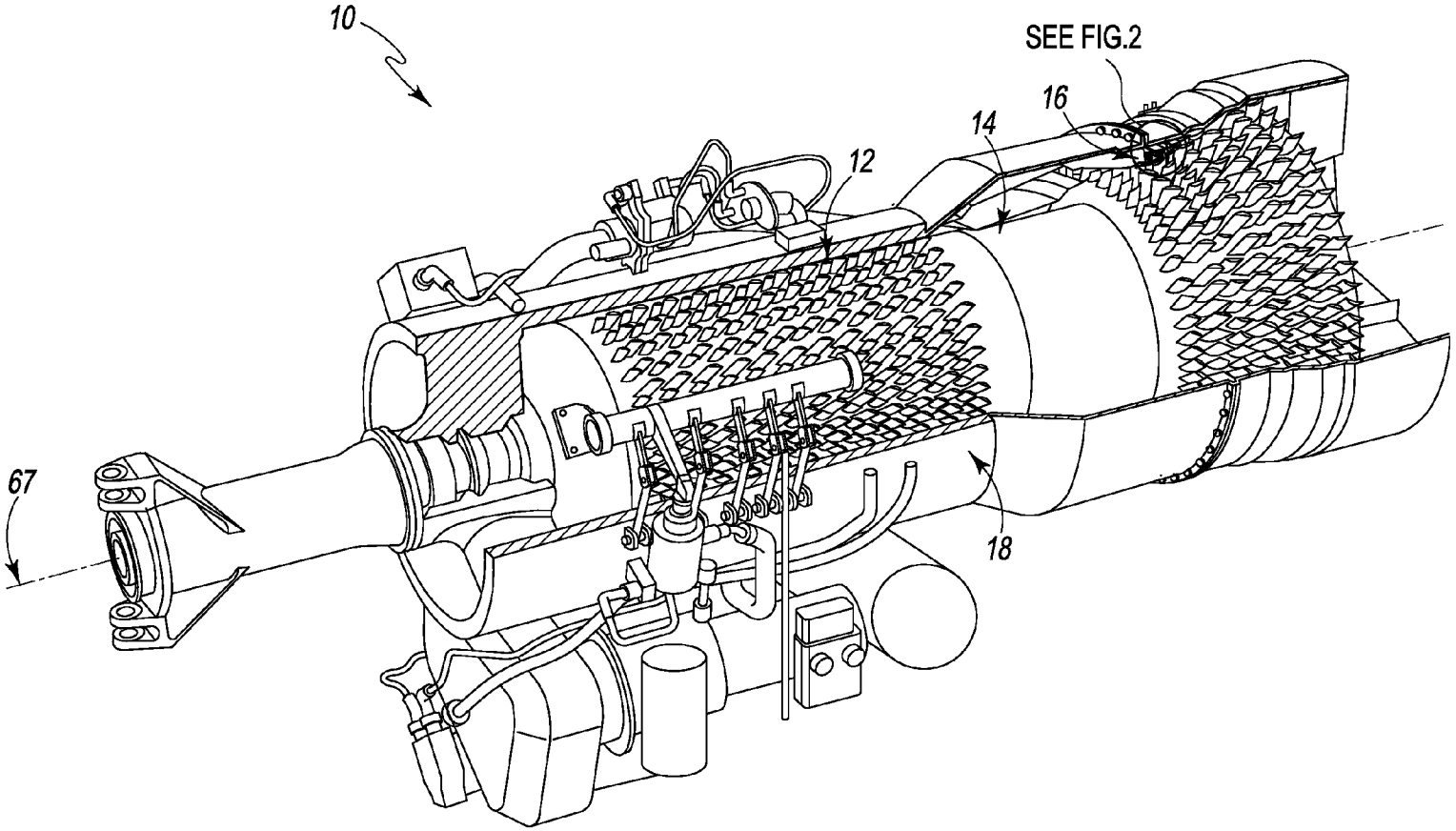
FIG. 1 depicts a cut-away perspective view of one embodiment of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring now to FIG. 1, a cut-away view of an illustrative aerospace gas turbine engine 10 is shown. The gas turbine engine 10 includes a compressor 12, a combustor 14, and a turbine 16, each of which is surrounded and supported by a metallic case 18. The compressor 12 is configured to increase the pressure and the temperature of atmospheric air and to deliver the air at the increased pressure and temperature to the combustor 14. The combustor 14 is configured to mix the air with fuel, ignite the air/fuel mixture, and deliver the combustion products (i.e., hot, high-pressure gases) to the turbine 16. The turbine 16 is configured to convert the combustion products to mechanical energy (i.e., rotational power) that drives the compressor 12 and an output shaft 21. Left-over combustion products from the turbine 16 may be discharged to a low pressure air stream, thereby producing thrust.

Figure 2:
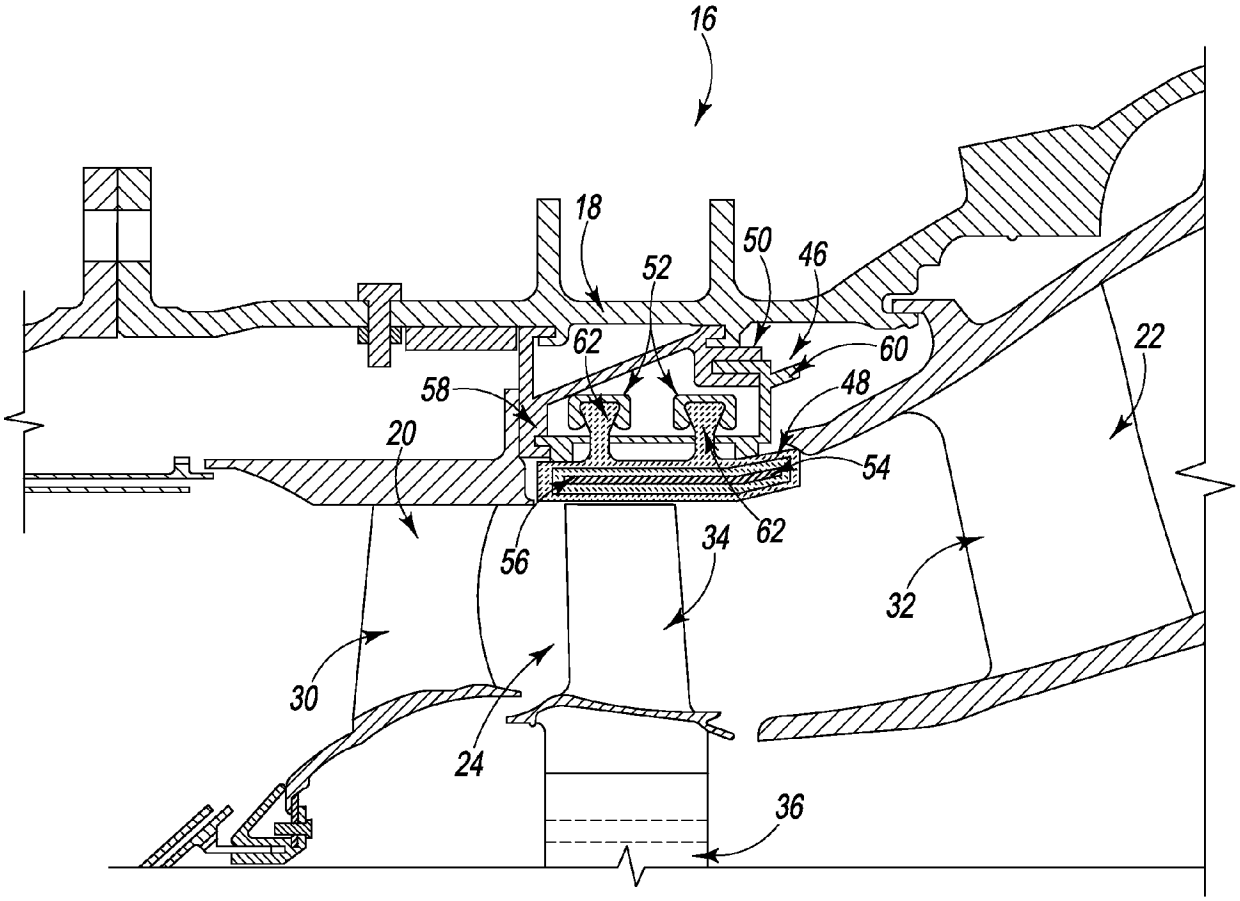
FIG. 2 depicts a sectional view of a portion of a turbine included in the gas turbine engine of FIG. 1.

Referring now to FIG. 2, a portion of the turbine 16 is shown to include a pair of static turbine vane assemblies 20, 22 and a turbine wheel assembly 24. Each static vane assembly 20, 22 includes a plurality of corresponding vanes 30, 32. The turbine wheel assembly 24 includes a plurality of blades 34 arranged circumferentially adjacent to one another about a disk 36 that supports the plurality of blades 34 for rotation.

In operation of the gas turbine engine 10, the vanes 30 of the static vane assembly 20 extend across the flow path of the combustion products delivered to the turbine 16 from the combustor 14 to direct the combustion products toward the plurality of blades 34 of the turbine wheel assembly 24. As a result, the combustion products push the plurality of blades 34 and cause the plurality of blades 34 to rotate.

A turbine shroud assembly 46 included in the turbine 16 is shown in FIG. 2. The turbine shroud assembly 46 blocks combustion products from passing over the blades 34 without pushing the blades 34 to cause rotation of the turbine wheel assembly 24. The turbine shroud assembly 46 includes a turbine blade track 48, a metallic support ring 50, a plurality of metallic retainers 52, a plurality of strip seals 54, and a plurality of strip-seal support inserts 56.

The turbine blade track 48 of the turbine shroud assembly 46 extends circumferentially to surround the turbine wheel assembly 24 to directly block combustion products delivered to the turbine 16 from passing over the turbine blades 34. Combustion products allowed to pass over the blades 34 of the turbine wheel assembly 24 do not cause the blades 34 to rotate, thereby contributing to lost performance within the engine 10. The turbine blade track 48 includes a plurality of blade track segments 49 as discussed below with regard to FIG. 3.

The metallic support ring 50 of the turbine shroud assembly 46 is coupled to the metallic case 18 and extends circumferentially to surround the turbine blade track 48 and support the blade track 48 relative to the case 18 as shown in FIG. 2. The metallic support ring 50 includes a segmented outer carrier 58 and a segmented inner carrier 60 coupled to the segmented outer carrier 58.

The plurality of metallic retainers 52 of the turbine shroud assembly 46 engage a pair of posts 62 of the blade track segments 49 (further discussed below with regard to FIG. 3) to couple the turbine blade track 48 to the metallic support ring 50 and therethrough to the case 18. In other embodiments, other means of attaching the blade track segments 49 to the case 18 may be employed.

Figure 3:
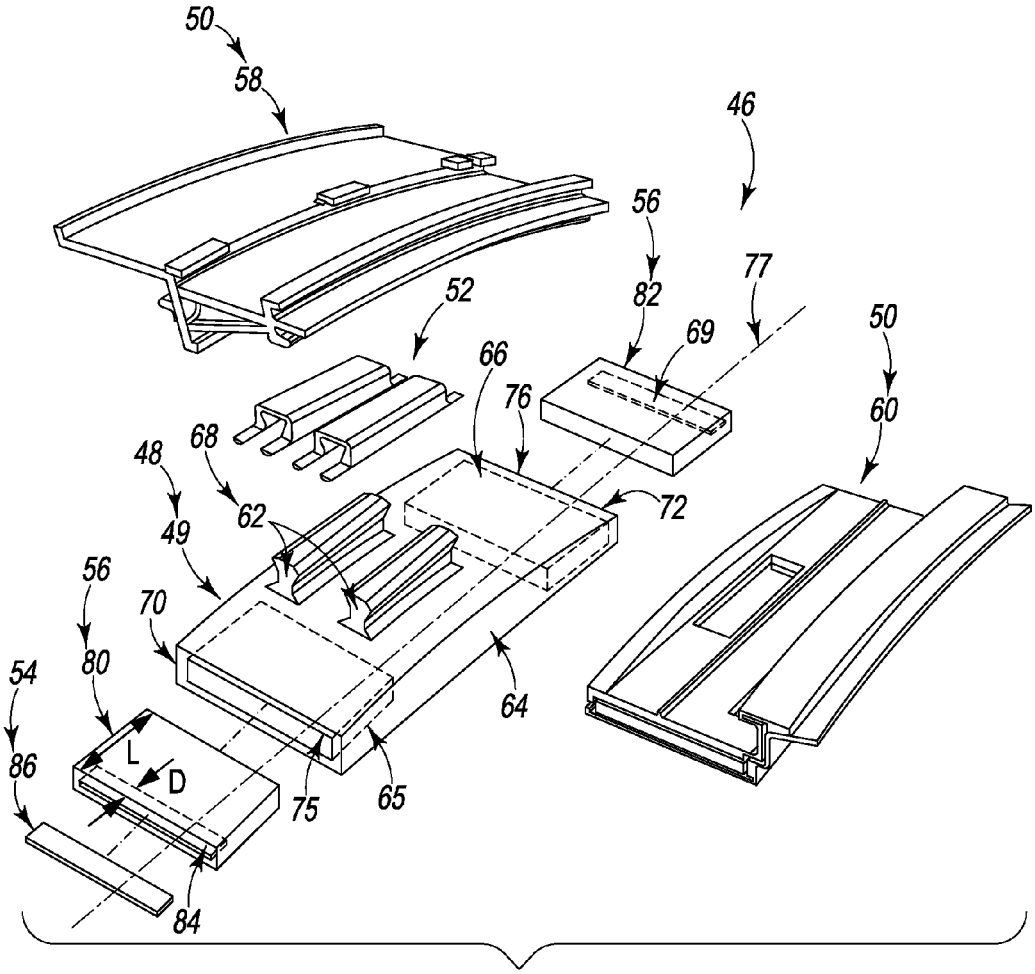
FIG. 3 depicts an assembly view of a portion of a turbine shroud included in the turbine of FIG. 2.

The plurality of strip seals 54 are located circumferentially between adjacent blade track segments 49 of the blade track 48 as shown in FIGS. 2 and 3. The plurality of strip seals 54 block combustion products delivered to the turbine 16 from passing through the blade track 48 at joints between blade track segments 49.

The plurality of strip-seal support inserts 56 are illustratively coupled to the blade track segments 49 of the blade track 48 as shown in FIGS. 2-3. The plurality of strip-seal support inserts 56 are configured to hold the plurality of strip seals 54 in place relative to the segments 49 of the blade track 48 so that slots for the strip seals 54 need not be cut into the blade track segments 49.

Referring now to FIG. 3, a perspective assembly view of one segment of the turbine shroud 46 of FIG. 2 is shown in one embodiment of the gas turbine engine 10. In the illustrative embodiment, the plurality of blade track segments 49, like the one shown in FIG. 3, are arranged circumferentially adjacent to one another such that the blade track 48 forms a ring. Each blade track segment of the plurality of blade track segments 49 is illustratively constructed of a ceramic matrix composite material. In one example, the ceramic matrix composite material may include silicon-carbide fibers formed into fabric sheets and a silicon-carbide matrix. In another example, the ceramic matrix composite material may include another ceramic-based material that including reinforcing fibers and a matrix material.

The one of the blade track segments 49 shown in FIG. 3 includes an arcuate runner 64, an attachment feature 68, and two insert-receiving cavities 65, 66. The other of the blade track segments 49 of the blade track 48 include substantially identical features to the one blade track segment shown in FIG. 3.

The arcuate runner 64 of the one blade track segment 49, in combination with the arcuate runners included in the other blade track segments 49, define a diameter about a central axis 67 extending longitudinally through the gas turbine engine 10 as suggested in FIGS. 1-3. The arcuate runner 64 is illustratively formed to include first and second insert-receiving cavities 65, 66 that open to face circumferentially adjacent insert-receiving cavities of other blade track segments 49.

The attachment feature 68 of the one blade track segment 49 is illustratively embodied as the posts 62 extending radially outwardly from the arcuate runner 64 as shown in FIG. 3. As suggested above, the plurality of metallic retainers 52 engage the posts 62 of the arcuate runner 64 to couple the one blade track segment 49 to the metallic support ring 50. The posts 62 are arranged on arcuate runner 64 such that no portion of the posts 62 is positioned directly above either of the insert-receiving cavities 65, 66 as shown in FIG. 3.

Each of the insert-receiving cavities 65, 66 of the one blade track segment 49 receives at least a portion of one of the strip-seal support inserts 56 as shown in FIG. 3. The insert-receiving cavities 65, 66 are located adjacent to opposing circumferential ends 70, 72 of the arcuate runner 64 as shown in FIG. 3. The insert-receiving cavity 65 extends through the end 70 and toward the end 72, and the insert-receiving cavity 66 extends through the end 72 and toward the end 70.

The insert-receiving cavities 65, 66 form channels 75, 76, respectively, that are sized to receive one of the plurality of strip-seal support inserts 56 as shown in FIG. 3. Each of the channels 75, 76 extends parallel to an axis 77 as shown in FIGS. 1-3.

Referring again to FIG. 3, illustrative strip-seal support inserts 80, 82 are received in the channels 75, 76 of the insert-receiving cavities 65, 66 such that the strip-seal support inserts 80, 82 are coupled to the ends 70, 72 of the arcuate runner 64, respectively. Each of the strip-seal support inserts 80, 82 is configured to receive one of the plurality of strip seals 54 to hold the one of the plurality of strip seals 54 in place relative to the segments 49 of the blade track 48.

The strip-seal support inserts 80, 82 are substantially identical to one another as shown in FIG. 3. As such, discussion below of the materials of construction and the structural features included in each of the strip-seal support inserts 80, 82 is confined to the strip-seal support insert 80.

The strip-seal support insert 80 is illustratively constructed of a rare earth silicate. For example, the strip-seal support insert 80 may be constructed of one of the following: yttrium pyrosilicate, yttrium orthosilicate, ytterbium pyrosilicate, or ytterbium silicate. In other embodiments, however, the strip-seal support insert 80 may be constructed of one of the following: mullite, an alkaline earth material, or an alkaline aluminosilicate material. In still other embodiments, other suitable materials may be used to make the strip-seal support insert 80.

The strip-seal support insert 80 is formed to include a strip-seal slot 84 as shown in FIG. 3. The body portion 81 defines the strip-seal slot 84. The strip-seal slot 84 extends into the strip-seal support insert 80 parallel to the axis 77 over a distance D less than the length L of the seal-support insert 80.

Figure 4:
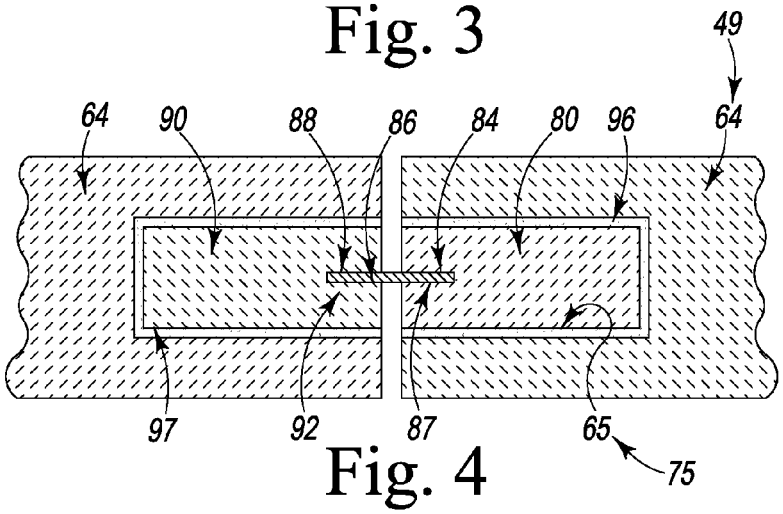
FIG. 4 depicts a side elevation view of components included in the portion of the turbine shroud of FIG. 3.

Referring to FIGS. 3-4, an illustrative strip seal 86 of the plurality of strip seals 54 is received in the strip-seal slot 84 of the seal-support insert 80. The plurality of strip seals 54 are illustratively metallic components. The strip seal 86 is sized so that a portion 87 of the strip seal 86 is received in the strip-seal slot 84 and another portion 88 of the strip seal 86 extends beyond the strip-seal slot 84 to a point outside of the strip-seal support insert 80 (see FIG. 4). The portion 88 of the strip seal 86 is configured to be received in a strip-seal slot 92 of an adjacent strip-seal support insert 90 as shown in FIG. 4.

Though not shown in FIG. 3, another strip seal of the plurality of strip seals 54 is configured to be received in a strip-seal slot 69 formed in the strip-seal support insert 82. As such, when the turbine shroud assembly 46 is installed as shown in FIG. 2, one strip seal of the plurality of strip seals 54 is at least partially positioned in each of the channels 75, 76 of the insert-receiving cavities 65, 66.

Referring now to FIG. 4, a cross-sectional side elevation view of circumferentially adjacent arcuate runners 64 of the embodiment of FIG. 3 is shown. Only one interaction between the runners 64 along the portion of the arcuate runner 64 where the strip-seal support insert 80 is positioned in the channel 75 of the insert-receiving cavity 65 is shown in FIG. 4. Though not shown in FIG. 4, another interaction between the runners 64 along the portion of the arcuate runner 64 where the strip-seal support insert 82 is positioned in the channel 76 of the insert-receiving cavity 66 is substantially identical to the one interaction. In the one interaction, the strip-seal support insert 80 is positioned in the insert-receiving cavity 65 such that substantially all of the strip-seal support insert 80 is received in the channel 75, and the strip seal 86 is positioned in the strip-seal slot 84.

The strip-seal support insert 80 is bonded to the arcuate runner 64 via a bonding layer 96 located in the insert-receiving cavities 65. The bonding layer 96 is positioned between the strip-seal support insert 80 and the arcuate runner 64 as shown in FIG. 4. In one example, the bonding layer 96 may be a braze layer. In another example, the bonding layer 96 may be a cement layer. The strip-seal support insert 90 is bonded to the other arcuate runner 64 via a bonding layer 97 located in the insert-receiving channel 94 that is substantially identical to the bonding layer 96.

Figure 5:
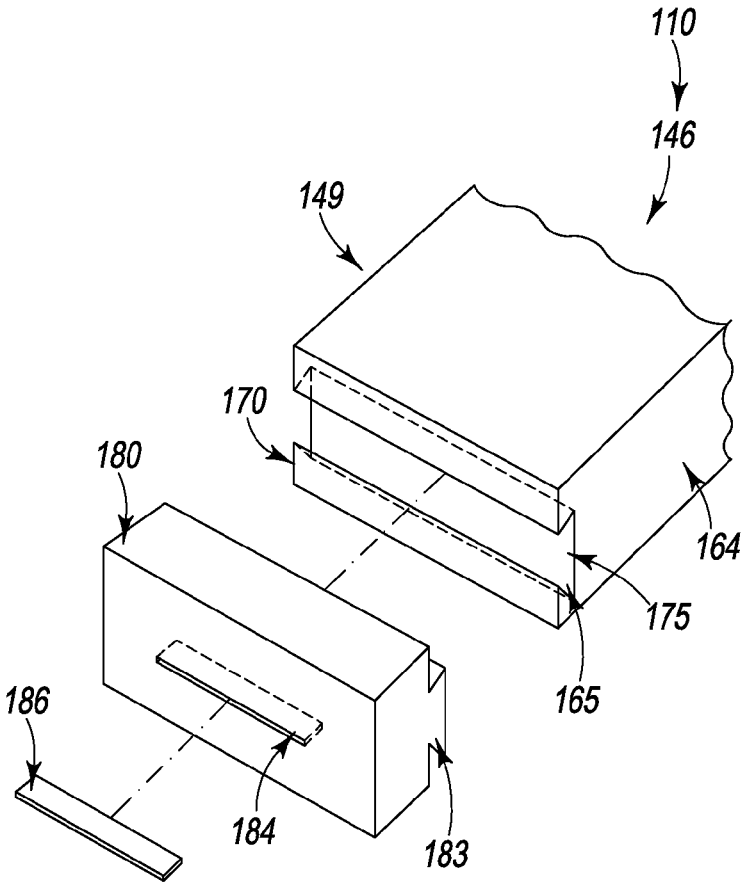
FIG. 5 depicts an assembly view of a portion of a turbine shroud included in a turbine in another embodiment of a gas turbine engine.

Referring to FIG. 5, a second strip-seal support insert 180 adapted for use with a second blade track segment 149 is shown in another illustrative turbine shroud 146. The turbine shroud 146 is configured for use in engine 110 and is substantially similar to the turbine shroud 46 shown in FIGS. 2-4 and described herein. Accordingly, similar reference numbers in the 100 series indicate features that are common between the turbine shroud 146 and the turbine shroud 46. The description of the engine 10 and the turbine shroud 46 are hereby incorporated by reference to apply to the turbine shroud 146, except in instances when it conflicts with the specific description and drawings of the turbine shroud 146.

Unlike the blade track segment 49, the blade track segment 149 includes an arcuate runner 164 that is formed to include a first insert-receiving cavity 165 through one end 170 and a second insert-receiving cavity through an opposite end (not shown in FIG. 5). The features formed in the ends of the arcuate runner 164 are substantially identical, and as such, discussion of those features is confined to the end 170.

Figure 6:
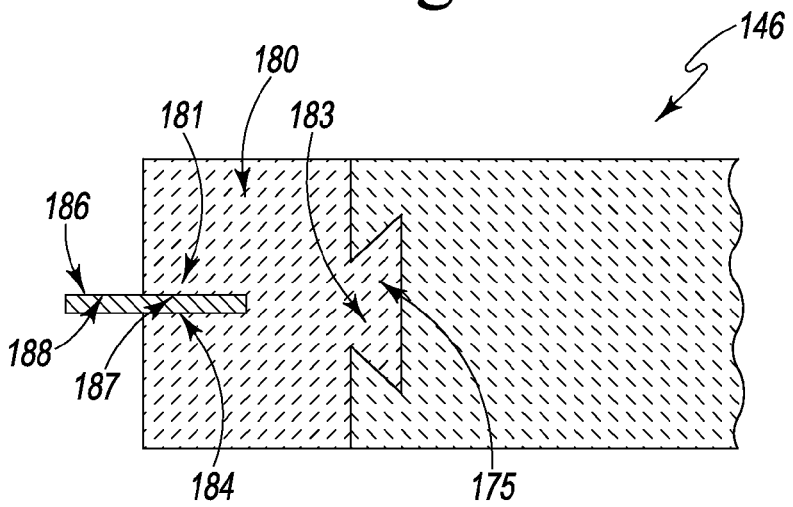
FIG. 6 depicts a side elevation view of components included in the portion of the turbine shroud of FIG. 5.

The insert-receiving cavity 165 of the arcuate runner 164 forms a channel 175 that receives the strip-seal support insert 180 as shown in FIG. 6. The channel 175 illustratively extends axially through the end 170 of the arcuate runner 164. In the illustrative embodiment, the channel 175 has a dove-tail shape.

The strip-seal support insert 180 is formed to include a body portion 181, an attachment portion 183, and a strip-seal slot 184 as shown in FIG. 5. The body portion 181 defines the strip-seal slot 184 and extends circumferentially out from the channel 175. The attachment portion 183 is received in the channel 175 and is configured to engage the arcuate runner 164 of the blade track segment 149 to block circumferential movement of the strip-seal support insert 180 relative to the blade track segment 149. The strip-seal slot 184 receives the strip seal 186 as shown in FIG. 6. The attachment portion 183 of the strip-seal support insert 180 illustratively has a dove-tail shape complementary to the dove-tail shape of the channel 175 as shown in FIG. 5.

Referring now to FIG. 6, a cross-sectional side elevation view of the blade track segment 149 is shown in which the strip-seal support insert 180 is positioned in the insert-receiving cavity 165 and the strip seal 186 is positioned in the strip-seal slot 184. The strip-seal support insert 180 is positioned in the insert-receiving cavity 165 such that only the attachment portion 183 is received in the channel 175. The strip seal 186 is positioned in the strip-seal slot 184 such that a portion of the strip seal 186 is received in the strip-seal slot 184 and another portion 188 of the strip seal 186 extends beyond the strip-seal slot 184 to a point outside of the strip-seal support insert 180.

Figure 7:
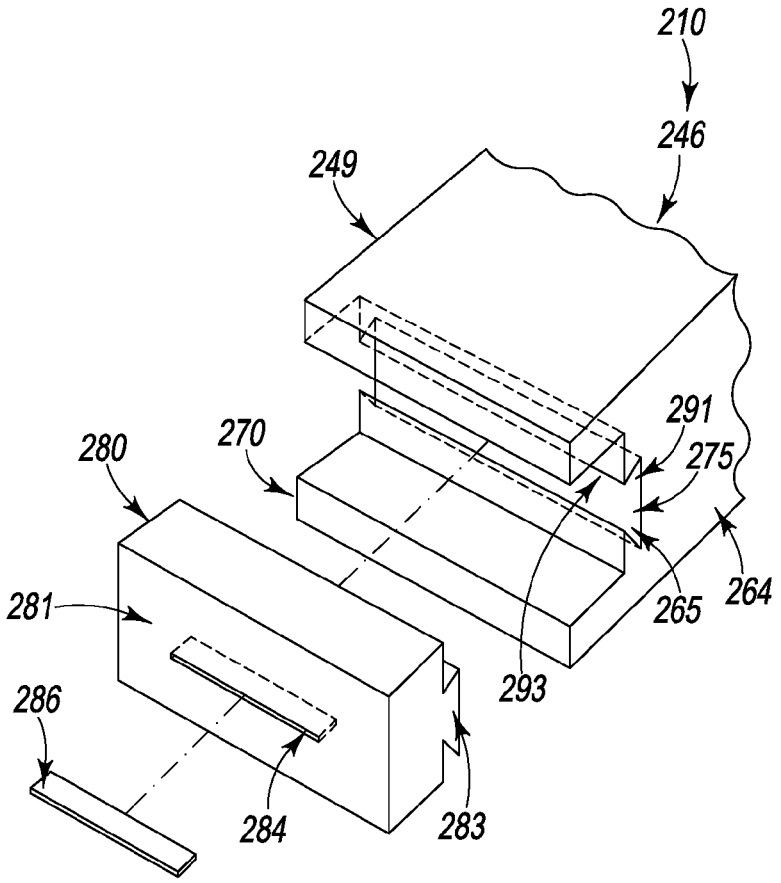
FIG. 7 depicts an assembly view of a portion of a turbine shroud included in a turbine in yet another embodiment of a gas turbine engine.

Referring to FIG. 7, a third strip-seal support insert 280 adapted for use with a third blade track segment 249 is shown in yet another illustrative turbine shroud 246. The turbine shroud 246 is configured for use in engine 210 and is substantially similar to the turbine shroud 46 shown in FIGS. 2-4 and described herein. Accordingly, similar reference numbers in the 200 series indicate features that are common between the turbine shroud 246 and the turbine shroud 46. The description of the engine 10 and the turbine shroud 46 are hereby incorporated by reference to apply to the turbine shroud 246, except in instances when it conflicts with the specific description and drawings of the turbine shroud 246.

Unlike the blade track segment 49, the blade track segment 249 includes an arcuate runner 264 that is formed to include a first insert-receiving cavity 265 through one end 270 and a second insert-receiving cavity through an opposite end (not shown in FIG. 7). The features formed in the ends of the arcuate runner 264 are substantially identical, and as such, discussion of those features is confined to the end 270.

The insert-receiving cavity 265 of the arcuate runner 264 forms a channel 275 that receives the strip-seal support insert 280 as shown in FIG. 7. The channel 275 illustratively extends through the axial end 270 of the arcuate runner 264. One portion 291 of the channel 275 has a dove-tail shape, and another portion 293 of the channel 275 has a rectangular shape. The portions 291, 293 of the channel 275 are interconnected and open into one another as shown in FIG. 7.

The strip-seal support insert 280 is formed to include a body portion 281, an attachment portion 283, and a strip-seal slot 284 as shown in FIG. 7. The body portion 281 defines the strip-seal slot 284. The attachment portion 283 is configured to engage the arcuate runner 264 of the blade track segment 249 to block circumferential movement of the strip-seal support insert 280 relative to the blade track segment 249. The strip-seal slot 284 receives the strip seal 286 as shown in FIG. 7. The attachment portion 283 of the strip-seal support insert 280 illustratively has a dove-tail shape complementary to the dove-tail shape of the portion 291 of the channel 275 as shown in FIG. 7.

Figure 8:
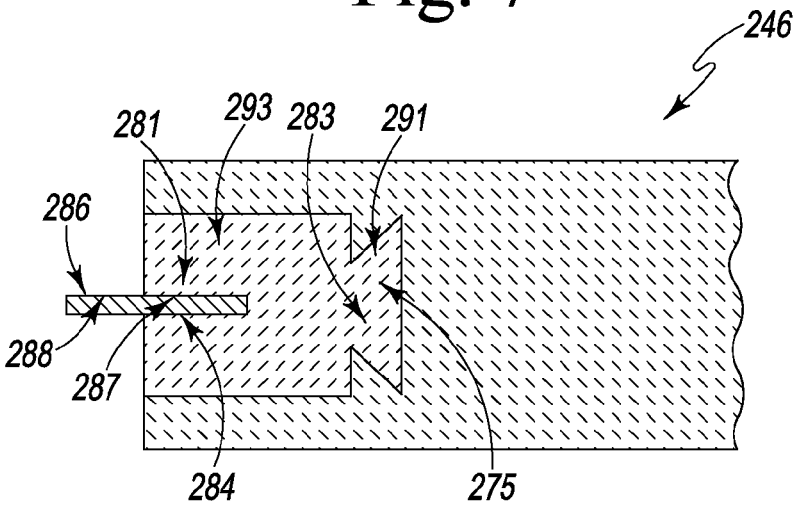
FIG. 8 depicts a side elevation view of components included in the portion of the turbine shroud of FIG. 7.

Referring now to FIG. 8, a cross-sectional side elevation view of the blade track segment 249 is shown in which the strip-seal support insert 280 is positioned in the insert-receiving cavity 265 and the strip seal 286 is positioned in the strip-seal slot 284. The strip-seal support insert 280 is positioned in the insert-receiving cavity 265 such that the attachment portion 283 is received in the dove-tail shaped portion 291 of the channel 275 and the body portion 281 is received in the other portion 293 of the channel 275. In the illustrative embodiment, the channel 275 of the blade track segment 249 receives all of the strip-seal support insert 280. The strip seal 286 is positioned in the strip-seal slot 284 such that a portion 287 of the strip-seal slot 286 is received in the strip-seal slot 284 and another portion 288 of the strip seal 286 extends beyond the strip-seal slot 284 to a point outside of the strip-seal support insert 280.

Referring to FIGS. 1-8, a method of assembling a turbine shroud 46, 146, or 246 includes the step of a forming a channel 75, 175, or 275 in one of a plurality of ceramic composite blade track segments 49, 149, or 249. The method further includes the step of positioning a strip-seal support insert 80, 180, or 280 having a slot 84, 184, or 284 formed therein in the channel 75, 175, or 275. The method further includes the step of positioning a strip seal 86, 186, or 286 in the slot such that a portion 88, 188, or 288 of the strip seal extends to a point outside of the slot. The method further includes the step of arranging the one ceramic blade track segment relative to another ceramic blade track segment 49, 149, 249 such that the portion is received in a slot 84, 184, or 284 of a strip-seal support insert 80, 180, or 280 positioned in a channel 75, 175, or 275 of the another ceramic blade track segment. In some embodiments, the method further includes the step of securing the strip-seal support insert in the channel using one of a braze or a cement layer 96.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A turbine shroud for a gas turbine engine, the turbine shroud comprising a plurality of ceramic matrix composite blade track segments arranged circumferentially adjacent to one another to form a ring, the plurality of ceramic matrix composite blade track segments cooperating to define a radial inner surface of the turbine shroud that is exposed to combustion products passed along a gas path during operation of the turbine shroud, a plurality of strip seals located circumferentially between adjacent ceramic matrix composite blade track segments, and a plurality of strip-seal support inserts coupled to the ceramic matrix composite segments and formed to include strip-seal slots that receive the plurality of strip seals to hold the strip seals in place relative to the plurality of ceramic matrix composite blade track segments.

2. The turbine shroud of claim 1, wherein each of the plurality of ceramic matrix composite blade track segments is formed to include an insert-receiving cavity that receives at least a portion of a strip-seal support insert.

3. The turbine shroud of claim 2, wherein each of the plurality of ceramic matrix composite blade track segments is bonded to a strip-seal support insert received in the insert-receiving cavity by a braze layer located in the insert-receiving cavity.

4. The turbine shroud of claim 2, wherein each of the plurality of ceramic matrix composite blade track segments is bonded to a strip-seal support insert received in the insert-receiving cavity by a bond layer located in the insert-receiving cavity.

5. The turbine shroud of claim 1, wherein each of the strip-seal support inserts is formed to include a body portion that defines the strip-seal slots and an attachment portion that is received in an insert-receiving cavity formed in each one of the ceramic matrix composite blade track segments, the attachment portion shaped to engage the ceramic matrix composite blade track segment and block circumferential movement of a strip-seal support insert relative to the ceramic matrix composite blade track segment.

6. The turbine shroud of claim 5, wherein the attachment portion of each strip-seal support insert has a dove-tail shape and the insert-receiving cavity of each ceramic matrix composite blade track segment includes an axially-extending dove-tail shaped channel that receives the attachment portion of each strip-seal support insert.

7. The turbine shroud of claim 5, wherein the insert-receiving cavity of each ceramic matrix composite blade track segment includes an axially-extending channel that receives both the body portion and the attachment portion of each strip-seal support insert.

8. The turbine shroud of claim 1, wherein the plurality of strip-seal support inserts are constructed from material including a rare earth silicate.

9. The turbine shroud of claim 1, wherein the plurality of strip-seal support inserts are constructed from a material including at least one of an alkaline earth material, an alkaline aluminosilicate material, and mullite.

10. A turbine shroud segment for a gas turbine engine, the turbine shroud segment comprising a ceramic matrix composite blade track segment including an arcuate runner that defines a radius around a central axis and an attachment feature adapted to couple the arcuate runner to a turbine case, a first strip-seal support insert coupled to a first end of the arcuate runner included in the ceramic matrix composite blade track segment, the first strip seal support insert formed to include a first strip-seal slot sized to receive a first strip seal located adjacent to the first end of the arcuate runner, and a second strip-seal support insert coupled to a second end, opposite the first end, of the arcuate runner included in the ceramic matrix composite blade track segment, the second strip-seal support insert formed to include a second strip-seal slot sized to receive a second strip seal located adjacent to the second end of arcuate runner.

11. The turbine shroud segment of claim 10, wherein the ceramic matrix composite blade track segment is bonded to each of the first strip-seal support insert and the second strip-seal support insert.

12. The turbine shroud segment of claim 10, wherein the first strip-seal support insert and the second strip-seal support insert are constructed from material including a rare earth silicate.

13. The turbine shroud segment of claim 10, wherein the first strip-seal support insert and the second strip-seal support insert are constructed from a material including at least one of an alkaline earth material, an alkaline aluminosilicate material, and mullite.

14. The turbine shroud segment of claim 10, wherein the ceramic matrix composite blade track segment is formed to include a first insert-receiving cavity that receives at least a portion of the first strip-seal support insert and a second insert-receiving cavity that receives at least a portion of the second strip-seal support insert.

15. The turbine shroud segment of claim 14, wherein the first insert-receiving cavity extends into the arcuate runner from the first end of the arcuate runner toward the second end of the arcuate runner and the second insert-receiving cavity extends into the arcuate runner from the second end of the arcuate runner toward the first end of the arcuate runner.

16. The turbine shroud segment of claim 14, wherein the first strip-seal support insert and the second strip-seal support insert are each formed to include a body portion that defines a strip-seal slot and an attachment portion that is received in the arcuate runner of the ceramic matrix blade track segment, the attachment portion shaped to engage the arcuate runner.

17. The turbine shroud segment of claim 16, wherein the attachment portions of the first strip-seal support insert and the second strip-seal support insert have a dove-tail shape.

18. The turbine shroud segment of claim 16, wherein the first and second insert-receiving cavities of the ceramic matrix composite blade track segment include an axially-extending channel that receives both the body portion and the attachment portion of the first and second strip-seal support inserts.

19. A method of assembling a turbine shroud for a gas turbine engine, the method comprising forming a channel in one of a plurality of ceramic matrix composite blade track segments, positioning a strip-seal support insert in the channel, the strip-seal support insert having a slot formed therein, positioning a strip seal in the slot such that a portion of the strip seal extends to a point outside of the slot, and arranging the one ceramic matrix composite blade track segment relative to another ceramic matrix composite blade track segment of the plurality of ceramic matrix composite blade track segments such that the portion is received in a slot of a strip-seal support insert positioned in a channel of the another ceramic matrix composite blade track segment.

20. The method of claim 19, further comprising securing the strip-seal support insert in the channel of the one of the plurality of ceramic matrix composite blade track segments using a braze layer.

* * * * *